United States Patent [19]

Kacmarcik et al.

[11] 4,247,210

[45] Jan. 27, 1981

[54] RIBBON FEED AND LIFT MECHANISM FOR A TYPEWRITER

[75] Inventors: Donald J. Kacmarcik; Selahattin A. Okcuoglu; Jerry W. Raider, all of Lexington, Ky.

[73] Assignee: International Business Machines Corporation, Armonk, N.Y.

[21] Appl. No.: 89,661

[22] Filed: Oct. 30, 1979

[51] Int. Cl.[3] ..... B41J 33/54

[52] U.S. Cl. ..... 400/236.1; 400/697.1

[58] Field of Search ..... 400/236.1, 240.1, 240.4, 400/697.1, 697, 695, 223, 225, 231, 208

[56] References Cited

U.S. PATENT DOCUMENTS

| | | | |
|---|---|---|---|
| 3,204,746 | 9/1965 | Wolowitz | 400/697.1 |
| 3,397,767 | 8/1968 | Hobbs | 400/236.1 X |
| 3,595,362 | 7/1971 | Wolowitz | 400/697.1 X |
| 3,747,734 | 7/1973 | Norman et al. | 400/236.1 X |
| 3,799,316 | 3/1974 | Davidge et al. | 400/697.1 |
| 3,927,746 | 12/1975 | Wolowitz | 400/697.1 X |
| 3,927,747 | 12/1975 | Wolowitz | 400/697.1 X |
| 3,997,046 | 12/1976 | Wolowitz | 400/697.1 |
| 4,108,557 | 8/1978 | Surzipek et al. | 400/697.1 |
| 4,172,672 | 10/1979 | Oddicini et al. | 400/697.1 X |
| 4,203,677 | 5/1980 | Hatsell | 400/236.1 X |

FOREIGN PATENT DOCUMENTS

| | | | |
|---|---|---|---|
| 1436757 | 8/1973 | Fed. Rep. of Germany | 400/697.1 |
| 2331080 | 1/1974 | Fed. Rep. of Germany | 400/697.1 |

OTHER PUBLICATIONS

"Combination Ribbon Mechanism", IBM Tech. Discl. Bulletin, vol. 23, No. 1, Jun. 1980, pp. 5–6.

"Control Means for Correction Mechanism on a Typewriter", IBM Tech. Discl. Bulletin, vol. 22, No. 10, Mar. 1980, pp. 4634–4636.

*Primary Examiner*—E. H. Eickholt

*Attorney, Agent, or Firm*—William J. Dick

[57] ABSTRACT

In a daisy wheel or rotary print wheel typewriter, a single motor is employed to accomplish both ribbon lift and feed for typewriter ribbon and correction ribbon loaded in a cartridge assembly. A single motor drive moves the cartridge assembly support about an axis to present the typewriter ribbon or the correction ribbon to the print point at the print line. When the elevation of the cartridge assembly about the axis is such to permit normal typing upon the typewriter ribbon, only the feed ratchet for the ribbon is engaged. Alternatively, when the rotation is greater, for example, for typing on the correction ribbon, the added elevation of the cartridge assembly effects disengagement of the normal ratchet feed for the typewriter ribbon while allowing advancement of the correction ribbon.

25 Claims, 11 Drawing Figures

RIBBON FEED AND LIFT MECHANISM FOR A TYPEWRITER

RELATED APPLICATIONS

See patent application Ser. No. 89662 filed concurrently herewith by Donald J. Kacmarcik and entitled "Improved Ribbon Feed and Lift Mechanism for Typewriters".

SUMMARY OF THE INVENTION AND STATE OF THE PRIOR ART

The present invention relates to typewriters and more specifically relates to ribbon feed and cartridge lift mechanism for presenting different portions of a ribbon or a correction ribbon to a print point along a print line of a typewriter and automatically feeding the print ribbon in response to the cartridge elevation.

There are numerous instances in the prior art of typewriter ribbon as well as correction ribbon feed which are coupled with mechanism for elevating or presenting different portions of typewriter ribbon as well as correction ribbon to a print line. For example, see patent application Ser. No. 801,286, filed on May 27, 1977, inventor J. O. Schaefer and entitled "Typewriter Cartridge and Feed Mechanism Therefor" which discloses a typewriter ribbon cartridge assembly including typewriter ribbon and correction ribbon in which separate drives are employed for elevating and depressing the cartridge assembly to present ribbon at the print point, and for feeding the ribbon, depending upon whether its print ribbon or correction ribbon, the dependence being upon the elevation of the cartridge about its supporting platform.

As presently advised, the most pertinent prior art is U.S. Pat. No. 4,111,293, issued on Sept. 5, 1978 and U.S. Pat. No. 710,144, issued on Sept. 30, 1902. The '293 patent does illustrate a single cartridge and reciprocation of the cartridge to present ribbon at the print point but utilizes a double motor drive, that is one motor for advancing the ribbon and a second solenoid motor for actuating and effecting the ribbon lift. In the present instance, as will be more completely explained hereinafter, both ribbon lift and drive are accomplished by a single drive motor. The '114 patent, alternatively, discloses a date stamp operation mechanism in which a hand lever having a pair of pawls is put into one of two positions, first to actuate one ratchet and then a second ratchet.

In view of the above, it is a principle object of the present invention to provide a simplified and economical ribbon lift and feed mechanism for a typewriter, specifically a typewriter of the rotary print wheel variety.

Another object of the present invention is to provide a single stepping motor control for both ribbon lift and feed for multiple ribbon cartridges carrying both typing ribbon and correction ribbon.

Other objects and a more complete understanding of the invention may be had by referring to the following specification and claims taken in conjunction with the accompanying drawings.

DRAWING DESCRIPTION

Figure 1:
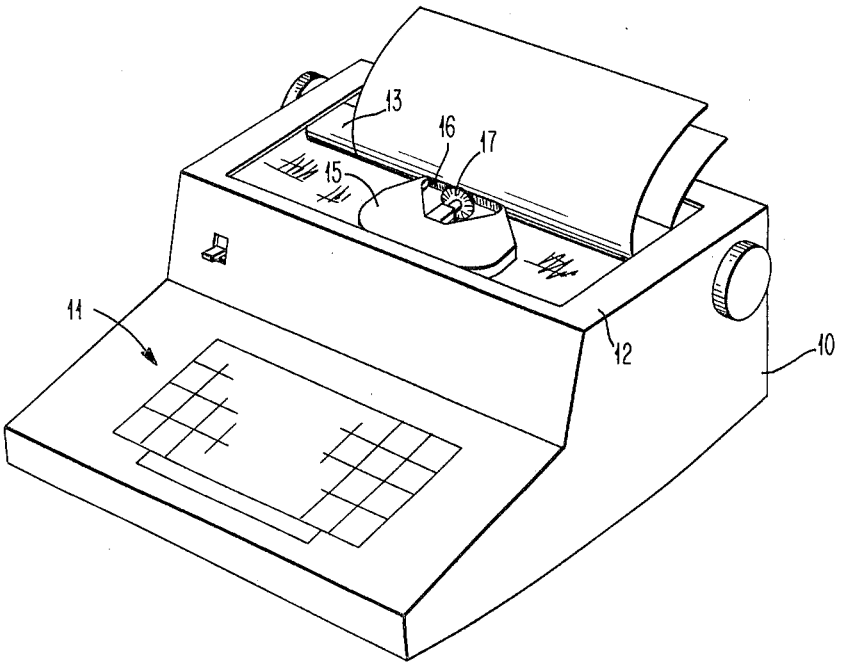
FIG. 1 is a perspective view of a typical typewriter of the rotary print wheel typewriting apparatus constructed in accordance with the present invention.

Turning now to the drawings, and especially FIG. 1 thereof, a typical typewriter 10 including a keyboard 11, frame 12 and paper receiving platen 13 are illustrated therein. Nested within the portion adjacent the platen 13 is a cartridge assembly 15 which includes at least a typewriter ribbon or the like 16 which passes exteriorally of the cartridge 15 intermediate the platen 13 and, in the illustrated instance, a print wheel or the like 17. The print wheel construction is similar to that found in many state of the art typewriters, and may typically be of the construction illustrated in U.S. Pat. No. 3,859,712. Typewriters of this type (the single element type) typically mount the ribbon feed and lift on a carrier which translates between the left and right margins associated with the platen along a print line.

Figure 2:
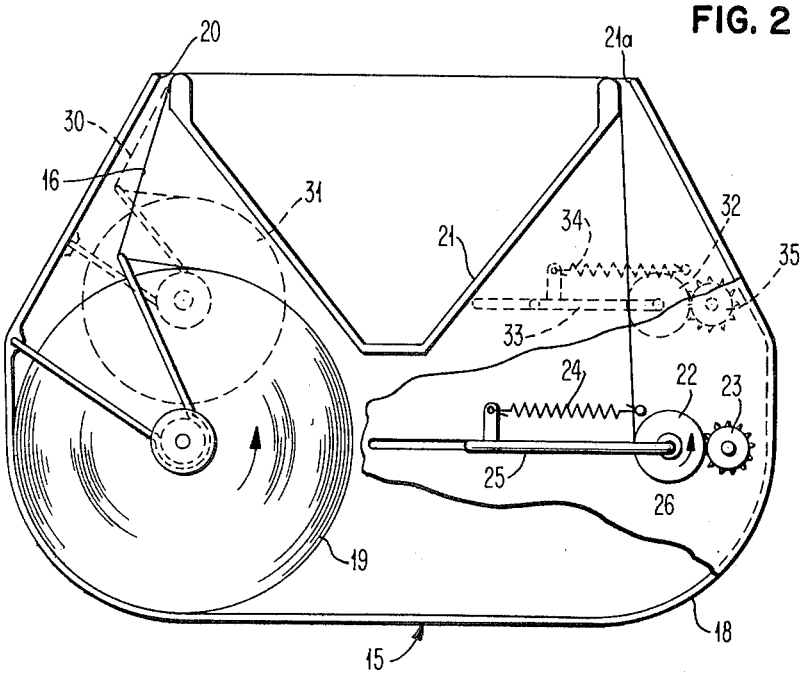
FIG. 2 is an enlarged fragmentary plan view of a typical cartridge assembly which may be employed with the apparatus of the present invention.

A typical ribbon cartridge assembly 15 is illustrated in FIG. 2, and includes a casing 18 having a print ribbon supply spool 19 for providing print ribbon 16 through an opening 20 externally of the casing 18. As illustrated, the print ribbon 16 traverses a recessed portion 21 in the casing 18 which provides an opening for the print wheel 17, the ribbon 16 entering a second aperture or opening 21 and being supplied to a take up spool 22. The take up spool 22 is biased against an internally and rotatably mounted spiked wheel driver 23 as by a biasing spring 24 which serves to bias a rod 25 which is captured at one end 26 by the take up spool 22 effectively pressing the take up spool 22 against the spiked driver 23. In this manner, as the spiked driver 23 rotates, the take up spool 22 becomes larger biasing the spring 24 but allowing for uniform increments of ribbon feed.

Moreover, the diameter of the spiked driver 23 may be changed depending upon the type of ribbon 16 being employed within the particular cartridge. For example, with a standard carbon type ribbon, no overlap between adjacent characters being printed is permissable and the feed rate of the ribbon as typing or printing progresses must be, in effect, greater than if the cartridge houses a multi-strike ribbon.

Immediately below the casing 18 is a second cartridge which may snap together to form the cartridge assembly 15 or, in the alternative may be incorporated as part of the cartridge to make the cartridge assembly. In either instance, (and for purposes of this application it is immaterial which form is desired), the second portion of the cartridge assembly 15 includes a second ribbon, in the preferred embodiment a correction ribbon 30 which may include lift off or cover up type material. The correction ribbon 30 is wound upon a supply spool 31, and extends through the opening 20 (or a like opening on a separate cartridge) and then proceeds through the opening 21 to a correction ribbon 30 take up spool 32. The correction ribbon 30 is biased in a similar manner to the print ribbon 16 as by a rod 33, which biases a spring 34 against a second spiked wheel driver 35, rotatably mounted within the cartridge assembly 15. A typical way in which the cartridges may be placed together, if separate cartridges are desired to make up the cartridge assembly 15, is illustrated in application Ser. No. 008,461, filed on Feb. 1, 1979 in an application of Boyatt, et al and entitled "Cartridge Assembly Apparatus for Typewriter", herein incorporated by reference, or in the Schaefer application, Ser. No. 801,286, filed on May 27, 1977, heretofore mentioned.

In accordance with the invention, novel means are provided for supporting the cartridge assembly 15 and reciprocating the assembly between a home position to permit typist visibility of the print line, and an elevated position to present a portion of the print ribbon intermediate the wheel 17 and the platen 13 to permit effecting typing on paper or the like held by the platen 13 of the typewriter, and for selectively feeding or incrementing either one of ribbon 16 or 30 depending upon the elevation of the cartridge assembly 15, without effecting feeding of the other of the ribbons. To this end, and referring first to FIGS. 3 and 4, the carrier 18 mounts thereon, as heretofore explained, the implements of printing including the print wheel 17 and its associated drive (not shown) as well as the cartridge assembly and its drive. As illustrated, the carrier includes upstanding posts or brackets 40 through which is journaled an axle 41 and depending cartridge support means or platform 42. Connected to the axle 41 is an extending gear segment 43 which includes teeth 44 on the extended terminal end thereof. The teeth 44 mesh with a pinion gear 45 which is connected to the shaft 46 of drive means, in the illustrated instance and preferred embodiment, a stepping motor 47. Inasmuch as the segment gear 43 is connected to the axle 41 which is connected in turn to the support 42, it is easy to see that rotation of the stepping motor will effect elevation or rotation of the cartridge support platform 42 about the brackets 40 presenting one or the other of the ribbon 16 and 30 to and in front of the printing portion (print petals 17*a*) of the print wheel 17, depending upon the number of steps of the motor, and the gear ratio between the segment gear 43 and the pinion gear 45, as well as the number of steps per revolution of the stepping motor 47.

In order to position a new or fresh ribbon portion (print ribbon 16, or correction ribbon 30), intermediate the petals 17*a* on the print wheel 17 and the platen 13, ribbon drive means 50, dependent upon the distance of the reciprocation of the cartridge assembly 15 about the axle 41 effect independent driving of the print ribbon 16 and correction ribbon 30. To this end, the ribbon drive means 50 includes a rack 51 which reciprocates interiorally of a housing 53 which depends from the cartridge assembly support 42 so that as the cartridge assembly 15 reciprocates so does the housing 53. As illustrated best in FIGS. 3 and 4, the rack 51 includes teeth 52 which mesh with a sector gear 54 mounted on a shaft 56 which passes through a sidewall 53*a* of the housing 53. The shaft 56 is connected to a pinion 57 which meshes with a driven gear 58, the driven gear 58 being rotatably mounted on the sidewall 53*a* of the housing 53. A gear segment 59 (FIG. 3) is connected to the carrier so that as the cartridge assembly reciprocates, the driven gear 58 effects rotation of the pinion 57 and thus the sector gear 54 causing the rack 51 to reciprocate in the direction of the arrow 51*a* illustrated in FIG. 4.

In order to effect unidirectional rotation of the spiked drivers 23 and 35 only as necessary or desired so as to present fresh portions of the print or correction ribbon to the petals 17*a* on the print wheel 17, means are provided for coupling directly to the spiked wheels of the cartridge assembly 15, and operate in synchronism with and dependent upon the distance of reciprocation or arc of travel of the cartridge assembly 15 about the axis or axle 41.

Figure 3:
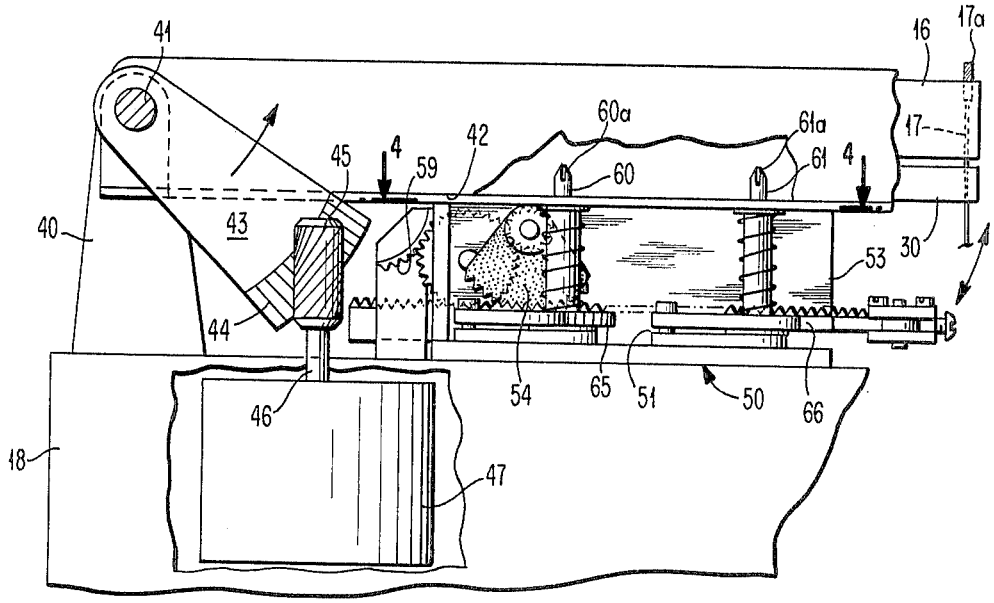
FIG. 3 is a fragmentary sectional side elevational view of the apparatus of the present invention and illustrating both the ribbon lift and ribbon advance features of the present invention as with a cartridge of the type illustrated in FIG. 2.
Figure 4:
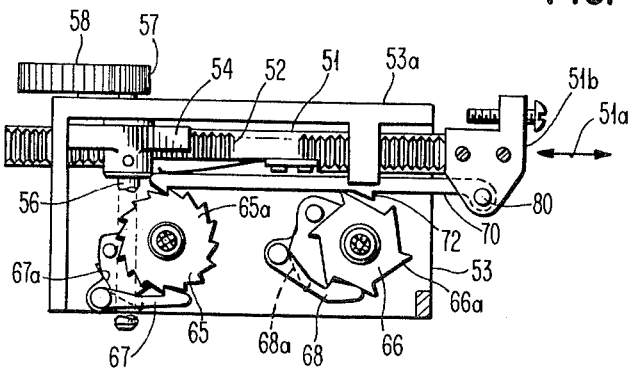
FIG. 4 is a fragmentary enlarged plan view taken along line 4—4 of FIG. 3.

As illustrated, the ribbon drive means 50 includes first and second upstanding pins 60 and 61 respectively which project through the cartridge assembly support means 42 and terminate in spline like ends 60*a*, 61*a* respectively for engagement with and into the spiked drivers 23 and 35. The pins 60 and 61 are connected within the housing 53 to first and second ratchet means 65 and 66 respectively, the ratchet means or ratchet 65 being employed therefore to drive the print ribbon 16, while the ratchet 66 is employed to drive the correction ribbon 30. As illustrated in FIGS. 3 and 4, the ratchets 65 and 66 are mounted for rotation in the housing 53, the ratchet 65 having radially extending peripherial teeth 65*a* thereon while the ratchet 66 has radially extending peripherial teeth 66*a* thereon. As shown, the ratchet 66 has a tooth pitch P1 greater than the tooth pitch P2 of the ratchet 65. Check pawls 67 and 68 which are spring loaded as by springs 67*a*, 68*a*, serve to inhibit rotation of the ratchets in the opposite direction (counterclockwise in FIG. 4) from their driven direction.

Figure 5:
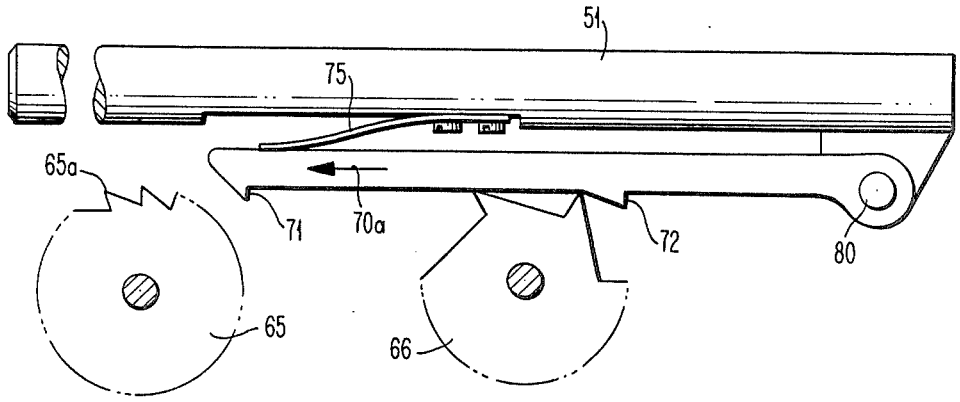
FIGS. 5-7 are enlarged schematic representations of a portion of the apparatus illustrated in FIGS. 3 and 4 and showing how the typing ribbon and the correction ribbon may be driven.
Figure 6:
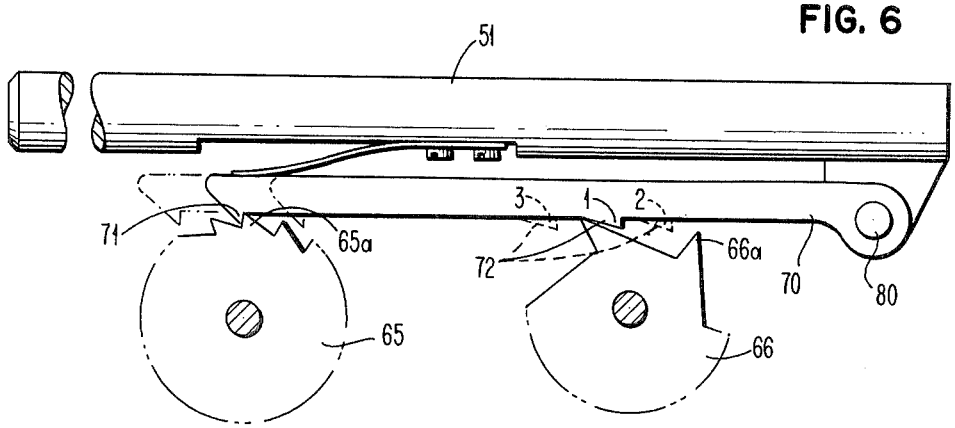
Figure 7:
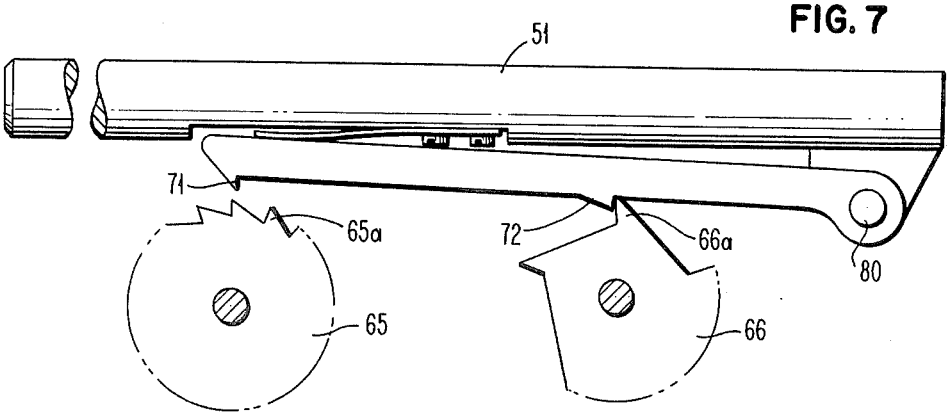

In order to effect unidirectional rotation of the ratchet 65 or 66 dependent upon the segment of arc traversed by the cartridge assembly 15 swinging about the axle 41, (i.e., whether print ribbon 16 is to be positioned opposite the petals 17*a* of the type wheel 17, or the correction ribbon 30 is to be positioned opposite the petals 17*a*), the rack 51 includes a terminal end 51*b* having a pawl driver 70 pivotally connected thereto as by a pivot pin 80, the pawl driver 70 including laterally extending, ratchet tooth engaging projections 71 and 72. The throw or travel of the rack 51 due to rotation of the sector gear 54 caused by upward rotation of the cartridge assembly 15 about the axle 41 to present print ribbon intermediate the type print 17*a* and the platen 13, causes the rack 51 to move to the right (relative to FIGS. 3 and 4) effecting engagement of the ratchet tooth engaging projection 71 with the teeth 65*a* of the ratchet 65 causing the ratchet to rotate in a clockwise direction which likewise effects clockwise rotation of the spiked driver 23 associated with the print ribbon 16. During the first segment of the arc of travel of the cartridge assembly about the axle 41, (i.e., that segment wherein the print ribbon 16 is opposite the petals 17*a*) because the pitch P2 of the teeth 65*a* of ratchet 65 is less than the pitch P1 of the teeth 66*a* of the ratchet 66, and the distance travelled therefore is less during the first segment of the arc as opposed to the second segment of the arc (wherein the correction ribbon 30 is opposite the petals 17*a*), only the ratchet 65 is rotated by the projection 71, the tooth 72 moving between positions 1 and 2, i.e., intermediate the adjacent tooth tips of the teeth 66*a* of ratchet 66. This is best illustrated in FIG. 6 wherein only the ratchet 65 is being driven by reciprocation of the rack 51. Additionally, in order to maintain pawl driver 70 pressure against the ratchets, and as illustrated best in FIGS. 5–7, the pawl driver 70 is biased towards the ratchet 65 and 66 as by a leaf spring 75.

When the cartridge assembly is elevated to the second segment of the arc of rotation about the axis or axle 41, the rack 51 moves farther to the left until the projection 72 of the pawl driver 70 is in the dotted line position labelled 3 in FIG. 6. Then as the cartridge assembly 15 is lowered, the pawl driver 70 reverses direction moving to the right and engaging a tooth 66*a* of the ratchet 66 effecting rotation of the ratchet 66 and causing feeding of the correction ribbon 30. As illustrated best in FIG. 7, as the pawl driver 70 moves to the right, due to the lowering of the cartridge assembly 15 and support 42, and inasmuch as the ratchet 66 is closer to the pivot pin 80 than the ratchet 65, one of the teeth 66*a* engaged by the projection 72 effects a camming action on the pawl driver 70 about the pivot 80 lifting pawl projection 71 away from ratchet 65 effecting only an advance of the correction ribbon 30 being driven by the ratchet 66.

In the preferred embodiment of the invention as illustrated in FIGS. 3–7, feeding of either ribbon only occurs during the depression of the cartridge assembly 15. Moreover, in order to insure print line visibility for the typist, it is preferable that the cartridge assembly 15 be depressed below the print line. To this end the home position for the cartridge assembly when it is depressed into a position illustrated in FIG. 3, i.e., below the print line, is illustrated with regard to the ribbon drive in FIG. 5. As shown, the projection 72 is past any of the teeth 66*a* of the ratchet 66 while the projection 71 is to the right of or past any of the teeth 65*a* of the ratchet 65. Thus as the rack 51 is again moved in a leftward direction and the pawl driver 70 is moved in the direction of the arrow 70*a*, for a new print cycle, the pawl projection 71 and 72 assume the position 1 illustrated in FIG. 6, and normal reciprocation during the first segment of the arc of travel of the cartridge assembly 15 is between positions 1 and 2 illustrated in FIG. 6.

Figure 8:
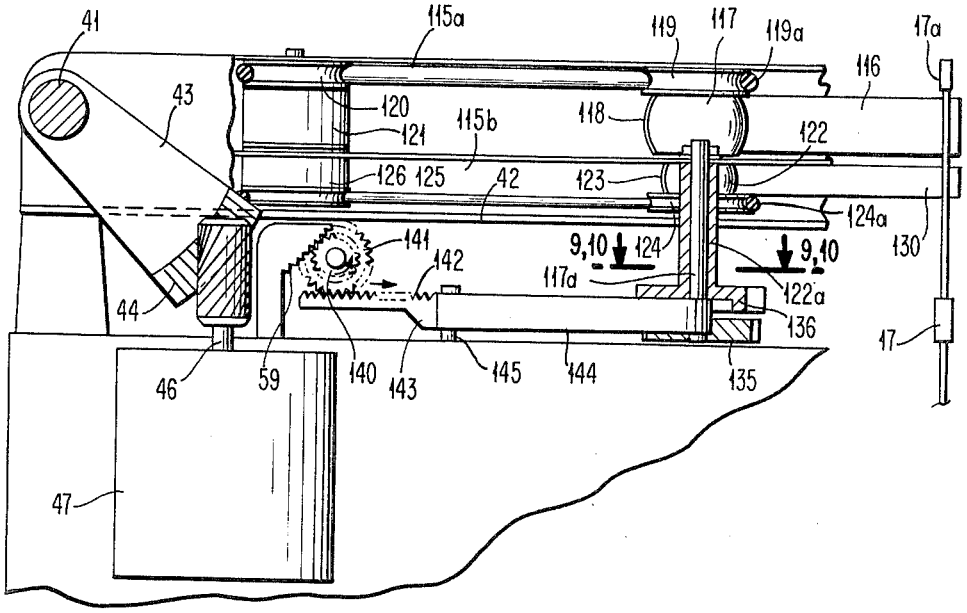
FIG. 8 is a fragmentary enlarged side elevational view similar to FIG. 3 but showing a modified version of mechanism constructed in accordance with the present invention.

An alternate embodiment of the invention is illustrated in FIG. 8, wherein a cartridge assembly 115 having typing ribbon 116 in a first cartridge 115*a*, and a correction ribbon 130 housed in a separate cartridge 115*b* is shown. The cartridges are positioned in superimposed overlapping relation, and joined, if desired, in any convenient manner. In the illustrated instance, the print ribbon 116 passes between a driver metering post 117 and a friction engageable spool 118, the spool 118 including a sheave or pulley 119 thereon which by means of a belt 119*a* is coupled to a second sheave or pulley 120 mounted on a take up spool 121. In a like manner, the correction ribbon 130 passes between a metering post 122 and a spool 123, the spool 123 including a sheave or pulley 124 which mounts a drive belt or O-ring 124*a* thereon for coupling to a second sheave 125 which is connected to a correction ribbon 130 take up spool 126. As illustrated in FIG. 8, the drive for each of the metering posts extends upwardly into the cartridge assembly 115. The post 117 is driven by a shaft 117*a* which terminates in a ribbon ratchet 135, while the drive for the metering post 122 associated with the correction ribbon 130 circumscribes the shaft 117*a* as by the sleeve 122*a* and is coupled to a correction ribbon ratchet 136.

Figure 9:
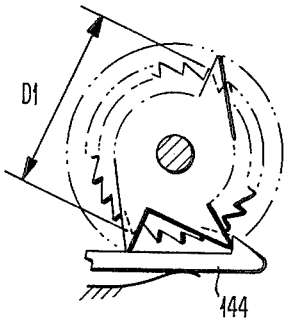
FIGS. 9 and 10 are fragmentary sectional views taken along lines 9,10—9,10 of FIG. 8 to illustrate both print ribbon and correction ribbon advance or feed.
Figure 10:
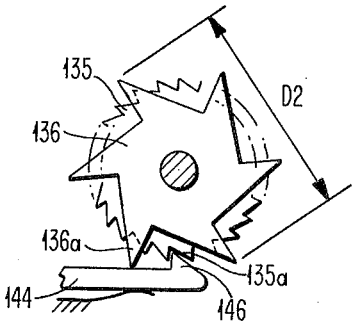

Inasmuch as the drives are concentric, a different arrangement of the pawl driver than that previously described with regard to FIGS. 3–7 must be provided. Inasmuch as the cartridge support 42, the drive or stepping motor 47, brackets 40 and axle 41 as well as the segmented gear 43 with teeth 44, pinion 45 and sector gear 59 are identical to that heretofore described relative to FIGS. 2–7, like parts have been given like numbers. As shown, the sector or segment gear 59 matches with a pinion gear 140 which is coupled to a rack drive gear 141 through the housing (removed for clarity) which depends from the support platform 42. The rack drive gear 141 meshes with the teeth 142 of a rack 143, the rack being coupled as by a hinge pin 145 to a pawl driver 144 which is spring biased into engagement with the ratchet 135 or, as will be become more clear hereinafter, the ratchet 136. As best illustrated in FIGS. 9 and 10, the pawl driver 144 includes a radially and inwardly projecting ratchet driver tooth 146 which during the normal printing cycle (i.e., when the typewriter ribbon 116 is opposite the type or petal 17*a* of the print wheel 17) engages the teeth 135*a* of the ratchet 135 (FIG. 10). In this embodiment the diameter D1 of the ratchet 135 is less than the diameter D2 of the correction ribbon ratchet 136 while the pitch of the teeth 135*a* is less than the pitch of the teeth 136*a* associated with the ratchet 136. Thus the normal swinging of the cartridge through the arc causes print ribbon to be fed while the ratchet driver 146 reciprocates intermediate adjacent teeth 136*a* of the correction ribbon ratchet 136. When the cartridge assembly 115 is elevated about the axle 41 to a height sufficient to place the correction ribbon 130 intermediate the print 17*a* of the print wheel 17, the pawl driver 144 will move to the position indicated in FIG. 9, and as the cartridge assembly is lowered due to the depression of the cartridge assembly 115 by the stepping motor 47, the correction ribbon ratchet 136 will be rotated, and due to its greater diameter effects a camming action of the pawl driver 144 away from the teeth 135*a* of the print ribbon ratchet 135.

Because both lift and feed are accomplished by the single stepping motor 47, virtually any ribbon may be employed merely by changing the size, internally of the cartridge, of the spiked wheels (23, 35, FIG. 7) or metering posts (122, 117, FIG. 8). Thus, for example, a multi strike ribbon such as the IBM Tech III print ribbon which may be packaged with cover up tape as the correction ribbon, or correctable film ribbon with the so called lift off tape as the correction ribbon may be packaged together to form the cartridge assembly 15 or 115. For example, in a multi strike ribbon there may be a five track lift pattern which then can be followed by a 1 mm feed increment, while in a correctable film ribbon a two track lift pattern can be employed, then followed by a 3 mm feed increment. This is accomplished merely by setting the pitch of the ratchet for the print ribbon such that a full segment of arc of travel of the cartridge assembly is necessary before the driver pawl engages the print ratchet to effect such a rotation.

Moreover, the increments of lift may be set simply by the ratio of the gearing between the pinion 45, and the segment gear 59 as is herein for the embodiment shown in FIG. 3, and the ratio of that segment or sector gear 59 and the pinion 140 and rack driver gear 141 illustrated in FIG. 8. For example, assume that the gear ratio is such that four steps of the stepping motor 47 yields one increment of lift. From the home position then, 24 steps of the motor 47 will lift the cartridge assembly and thus the print ribbon to, for example, its first typing track. From there, in the instance of a multi strike ribbon, four steps are required for each increment of lift until the fifth track, then down to the first track using 16 steps (feeding the ribbon) and so forth. For correction, 70 motor steps are required from the home position to lift the cartridge assembly sufficiently to place the lift off tape or correction ribbon opposite the type or petals 17*a* on the print wheel 17 for a lift off correction. After correction the cartridge assembly is lowered using 70 motor steps to feed the correction ribbon.

Figure 11:
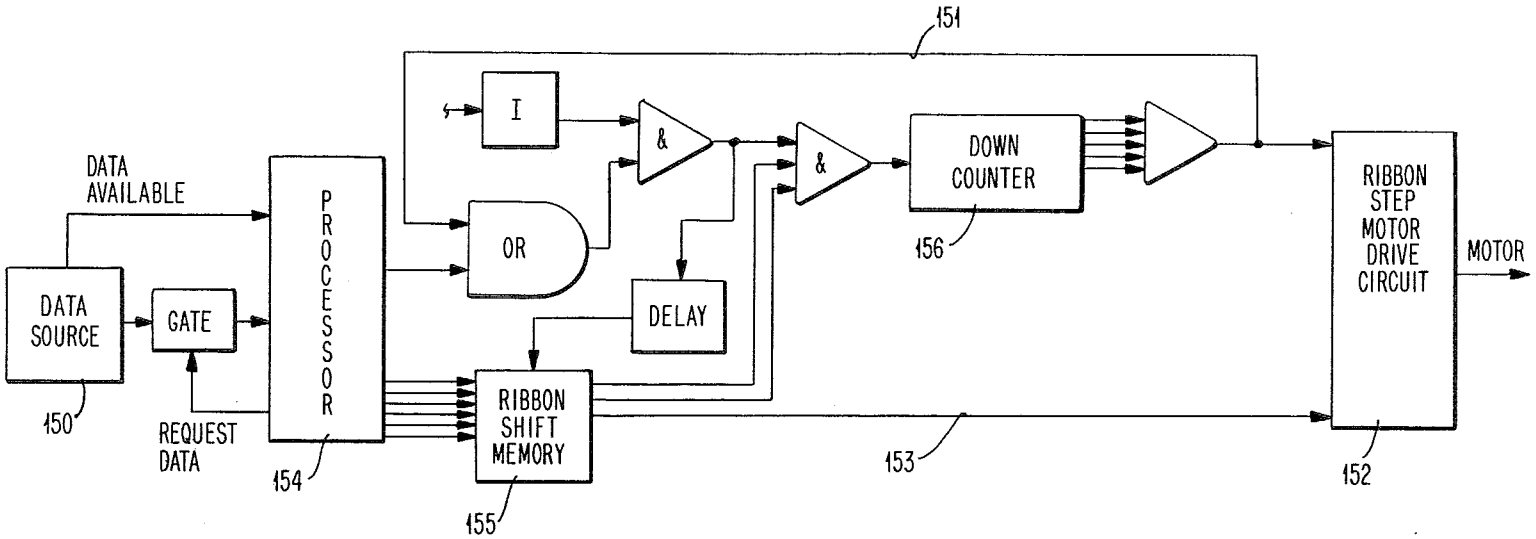
FIG. 11 is a schematic circuit diagram illustrating a typical means by which ribbon lift and feed may be accomplished.

The circuitry which operates the stepping motor may be of any convenient type, one such example being illustrated in FIG. 11 which is essentially the circuitry illustrated in U.S. Pat. No. 4,030,591, issued on June 21, 1977 to Martin et al. As illustrated in FIG. 11, the data which serves to position the ribbon is derived from a data source 150 which may be connected to or part of the keyboard 11 of the typewriter 10. In response to the data, the circuitry illustrated in FIG. 11 generates a series of pulses on line 151 which activates the motor drive circuit 152 such that the stepping motor 47 moves the ribbon to the required track. The signals on line 153 indicate the direction which the stepper motor should move. Each pulse on line 151 causes the stepping motor to move one step. The programmed commands from the data source 150 through the processor 154, ribbon shift register or memory 155 and the counter 156 emits 24 pulses to the drive circuit 152 to lift the ribbon to the first track and an additional 16 pulses to go the fifth track.

Set forth below is a typical set of ribbon commands for correctable film ribbon:

| Item No. | Ribbon Command | Timing Nos. | No. of Timing Numbers |
|---|---|---|---|
| 1. | Go to 1st P.P. after V.T. | N1–N24 | 24 |
| 2. | Go to 2nd P.P. after V.T. | N25–N66 | 40 |
| 3. | Go to Erase after V.T. | N67–N138 | 70 |
| 4. | Go to 2nd P.P. after 1st P.P. | N139–N156 | 16 |
| 5. | Go to 1st P.P. after 2nd P.P. | N157–N174 | 16 |
| 6. | Go to V.T. after 1st P.P. | N175–N198 | 24 |
| 7. | Go to V.T. after end P.P. | N199–N240 | 40 |
| 8. | Go to V.T. after erase | N241–N312 | 70 |

V.T. is abbreviation for View Text Position (Home Position)
P.P. is abbreviation for Print Position (i.e., track)

As may be seen from the above ribbon commands, if the typewriter rate exceeds some predetermined rate (for example, a burst of characters) then the cartridge assembly 15 or 115 does not go to the home or View Text (V.T.) position but proceeds directly to the next Print Position (P.P.) or appropriate track. Item No. 4 and 5 are directly in point wherein the command for ribbon lift is "Go to 2nd P.P. after 1st P.P." and "Go to 1st P.P. after 2nd P.P.". In the motor command table set forth below, (which is located in ROM in the processor) the status of any of the commands may be found. The numbers indicate "Item No." from the table above, and relate to a correctable film ribbon. It should be noted that the ribbon commands opposite "Erase Character" are multiple. For example under "Print", "PP1", the item numbers 6-3-8 means ribbon command 6 followed by ribbon command 3 followed by ribbon command 8.

MOTOR COMMAND TABLE

| | | Last Status | | | |
|---|---|---|---|---|---|
| | | Print | | Erase or No Character | |
| | | P.P. 1 | P.P. 2 | P.P. 1 | P.P. 2 |
| New Command From Keyboard | Print Character | 4 | 5 | 2 | 1 |
| | No Character | 6 | 7 | No ribbon command | No ribbon command |
| | Erase Character | 6-3-8 | 7-3-8 | 3-8 | 3-8 |

Thus the apparatus of the present invention provides ribbon feed and lift mechanism which is simple in nature but which provides for a single motor drive to take care of both ribbon lift and ribbon feed.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed:

What is claimed is:

1. In a typewriter having provisions for receiving a typewriter ribbon and a correction ribbon in a cartridge including separate take-up spools; cartridge support means for oscillating said cartridge and presenting different portions of said ribbon to a print point along a print line and selectively presenting correction ribbon to said print point, the improvement comprising:

separate typewriter ribbon and correction ribbon drives for feeding respectively typewriter ribbon and correction ribbon, said typewriter ribbon drive comprising;

motor means connected to said cartridge support means for oscillating said support means in an arc about an axis substantially parallel to said print line to present during a first segment of the arc, typewriter ribbon opposite the print point, and during a second segment of the arc correction ribbon opposite the print point;

a first reciprocating drive member coupled to said motor means and having a distance of reciprocation proportional to the segment of arc traversed by said support means during its oscillation;

first and second ratchet members respectively coupled to said typewriter ribbon and correction ribbon take-up spools to effect rotation thereof;

pawl means connected to said drive member and including ratchet engaging means for effecting unidirectional rotation of said first ratchet member during the first segment of an arc traversed by said support means without rotation of said second ratchet member, and means for camming said ratchet engaging means away from said first ratchet member while maintaining engagement with said second ratchet member for effecting unidirectional rotation of said second ratchet member only during the second segment of arc traversed by said support means.

2. In a typewriter in accordance with claim 1 including a housing connected to said support means, said ratchet members and pawl means being supported by said housing.

3. In a typewriter in accordance with claim 2 wherein said reciprocating drive member comprises rack means supported for reciprocation within said housing, gear means coupled to said rack means to effect reciprocation thereof upon reciprocation of said support means.

4. In a typewriter in accordance with claim 3 wherein said ratchet members are spaced apart in said housing, each of said ratchet members including a plurality of spaced apart, peripherally extending teeth thereon; said teeth of said second ratchet member having a pitch greater than the pitch of the teeth of said first ratchet member so that said ratchet engaging means reciprocates intermediate adjacent teeth of said second ratchet member during the first segment of arc traversed by said support means.

5. In a typewriter in accordance with claim 4 wherein said second ratchet member has a greater outside diameter than said first ratchet member.

6. In a typewriter in accordance with claim 5 including a first shaft extending upwardly through said support means and connected to said first ratchet member, and sleeve means circumscribing said first shaft and extending upwardly through said support means and connected to said second ratchet member.

7. In a typewriter in accordance with claim 2 wherein said ratchet members are spaced apart in said housing, each of said ratchet members including a plurality of spaced apart, peripherally extending teeth thereon; said teeth of said second ratchet member having a pitch greater than the pitch of the teeth of said first ratchet member so that said ratchet engaging means reciprocates intermediate adjacent teeth of said second ratchet member during the first segment of arc traversed by said support means.

8. In a typewriter in accordance with claim 7 including pivot means mounting said pawl means to said drive member, said second ratchet member being closer to said pivot means than said first ratchet member.

9. In a typewriter in accordance with claim 8 wherein said ratchet engaging means includes first and second spaced apart projections on said pawl means, said first projection for engaging the teeth of said first ratchet member and said second projection for engaging the teeth of said second ratchet member.

10. In a typewriter in accordance with claim 9 wherein said means for camming said first ratchet engaging member away from said first ratchet member comprises a tooth of said second ratchet engaging said pawl means during the oscillation of said support means in said second segment of arc thereby effecting disengagement of said first projection from the teeth of said first ratchet member.

11. In a typewriter in accordance with claim 10 including first and second check pawls in engagement respectively with said first and second ratchet members to inhibit reverse rotation of said ratchet members.

12. In a typewriter in accordance with claim 7 wherein said typewriter includes a carrier; upstanding bracket means mounted on said carrier, an axle on said bracket means mounting said support means and forming an axis of rotation for said support means; a first gear connected to said support means, said motor means including a drive gear thereon for meshing with said first gear to effect rotation of said support means about said axis of rotation.

13. In a typewriter in accordance with claim 12 including a second gear fixed to said carrier, a driver gear mounted on said housing on said support means, and meshed with said second gear so that upon rotation of said support means said driver gear rotates; and means connecting said driver gear to said reciprocating drive member to effect said reciprocation.

14. In a typewriter in accordance with claim 13 wherein said reciprocating drive member comprises a rack supported for reciprocation within said housing, and said means connecting said reciprocating rack to said driver gear comprises at least a third gear.

15. A typewriter including a typing platen and a carrier translatable along said platen, said carrier mounting a typing element and including means for receiving a typewriter ribbon and a correction ribbon mated together in overlapping superimposed relation to form a cartridge assembly, including separate take-up spools; cartridge support means for oscillating said cartridge assembly and presenting different portions of said ribbon to a print point intermediate said typing element and said platen and along a print line and selectively presenting correction ribbon to said print point; motor means connected to said cartridge support means for oscillating said support means in an arc about an axis substantially parallel to said print line to present during a first segment of the arc, typewriter ribbon opposite the print point, and during a second segment of the arc correction ribbon opposite the print point; separate typewriter ribbon and correction ribbon drives for feeding respectively typewriter ribbon and correction ribbon during oscillation of said support means, said typewriter ribbon drive comprising; a first reciprocating drive member coupled to said motor means and having a distance of reciprocation proportional to the segment of arc traversed by said support means during its oscillation; first and second ratchet members respectively coupled to said typewriter ribbon and correction ribbon take-up spools to effect rotation thereof; each of said ratchet members including a plurality of circumferentially projecting teeth thereon, the teeth of said second ratchet member having a pitch greater than the pitch of the teeth of said first ratchet member; pawl means connected to said drive member and including ratchet engaging means for effecting unidirectional rotation of said first ratchet member during the first segment of an arc traversed by said support means and due to the distance of reciprocation of said pawl means being less than the pitch of said second ratchet member, without rotation of said second ratchet member; said ratchet engaging means effecting unidirectional rotation of said second ratchet member only during the second segment of arc traversed by said support means, one of said teeth of said second ratchet member serving as a cam for camming the pawl means out of engagement with said first ratchet member.

16. A typewriter in accordance with claim 15 including a housing connected to said support means, said ratchet members and pawl means being supported by said housing.

17. A typewriter in accordance with claim 16 wherein said reciprocating drive member comprises rack means supported for reciprocating within said housing, gear means coupled to said rack means to effect reciprocation thereof upon reciprocation of said support means.

18. A typewriter in accordance with claim 15 wherein said second ratchet member has a greater outside diameter than said first ratchet member.

19. A typewriter in accordance with claim 18 including a first shaft extending upwardly through said support means and connected to said first ratchet member, and sleeve means circumscribing said first shaft and extending upwardly through said support means and connected to said second ratchet member.

20. A typewriter in accordance with claim 19 including separate means on said shaft and sleeve for engaging a ribbon drive means interiorly of said cartridge assembly.

21. A typewriter in accordance with claim 15 including pivot means mounting said pawl means to said drive member, said second ratchet member being closer to said pivot means than said first ratchet member.

22. A typewriter in accordance with claim 21 wherein said ratchet engaging means includes first and second spaced apart projections on said pawl means, said first projection for engaging the teeth of said first ratchet member and said second projection for engaging the teeth of said second ratchet member.

23. A typewriter in accordance with claim 15 including upstanding bracket means mounted on said carrier, an axle on said bracket means mounting said support means and forming an axis of rotation for said support means; a first gear connected to said support means, said motor means including a drive gear thereon for meshing with said first gear to effect rotation of said support means about said axis of rotation.

24. A typewriter in accordance with claim 23 including a second gear fixed to said carrier, a driver gear mounted on said housing on said support means, and meshed with said second gear so that upon rotation of said support means said driver gear rotates; and means connecting said driver gear to said reciprocating drive member to effect said reciprocation.

25. A typewriter in accordance with claim 24 including first and second check pawls in engagement respectively with said first and second ratchet members to inhibit reverse rotation of said ratchet members.

* * * * *